US007392840B2

(12) United States Patent
Griffith et al.

(10) Patent No.: US 7,392,840 B2
(45) Date of Patent: Jul. 1, 2008

(54) METHOD AND MEANS TO SEAL THE CASING-BY-CASING ANNULUS AT THE SURFACE FOR REVERSE CIRCULATION CEMENT JOBS

(75) Inventors: James E. Griffith, Loco, OK (US); Caleb Carroll, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 134 days.

(21) Appl. No.: 11/314,044

(22) Filed: Dec. 20, 2005

(65) Prior Publication Data

US 2007/0137870 A1 Jun. 21, 2007

(51) Int. Cl.
*E21B 33/03* (2006.01)
*F16L 3/16* (2006.01)

(52) U.S. Cl. ..... 166/88.1; 285/123.1; 285/123.3

(58) Field of Classification Search ..... 166/88.1, 166/97.5; 285/123.1, 123.3, 123.12, 124.4
See application file for complete search history.

(56) References Cited

U.S. PATENT DOCUMENTS 1,942,213 A * 1/1934 Howard ..... 285/123.12
2,223,509 A 12/1940 Brauer
2,230,589 A 2/1941 Driscoll
2,382,578 A * 8/1945 Penick ..... 166/155
2,407,010 A 9/1946 Hudson
2,472,466 A 6/1949 Counts et al.
2,485,497 A * 10/1949 Lemley et al. ..... 285/96

(Continued)

FOREIGN PATENT DOCUMENTS

EP 0 419 281 A2 3/1991

(Continued)

OTHER PUBLICATIONS

Griffith, et al., "Reverse Circulation of Cement on Primary Jobs Increases Cement Column Height Across Weak Formations," Society of Petroleum Engineers, SPE 25440, 315-319, Mar. 22-23, 1993.

(Continued)

*Primary Examiner*—Jennifer H Gay
*Assistant Examiner*—Daniel P Stephenson
(74) *Attorney, Agent, or Firm*—John W. Wustenberg; Baker Botts, L.L.P.

(57) ABSTRACT

A method for sealing an annulus defined between an outer casing and an inner casing, the method having steps as follows: fastening a lock ring to an anchor base, wherein the lock ring comprises a threaded fastener of the lock ring to the head; positioning the lock ring and anchor base about the outer casing; fastening a limit clamp to an exterior surface of the outer casing; repositioning the lock ring and anchor base so that the anchor base is in contact with the limit clamp; fastening a head to the lock ring; providing an opening for fluid communication with the annulus through the head; positioning a plug about the inner casing and in contact with the inner casing and the head; positioning a seal fitting clamp about the inner casing and in contact with the plug; positioning a bull cap about the inner casing and in contact with the seal fitting clamp; and fastening the bull cap to the head.

9 Claims, 9 Drawing Sheets

U.S. PATENT DOCUMENTS 2,647,727 A 8/1953 Edwards
2,675,082 A 4/1954 Hall
2,849,213 A 8/1958 Failing
2,919,709 A 1/1960 Schwegman
3,051,246 A 8/1962 Clark, Jr. et al.
3,096,075 A * 7/1963 Brown ..... 254/29 R
3,193,010 A 7/1965 Bielstien
3,277,962 A 10/1966 Flickinger et al.
3,354,962 A * 11/1967 Pierce, Jr. ..... 166/89.1
3,948,322 A 4/1976 Baker
3,948,588 A 4/1976 Curington et al.
3,951,208 A 4/1976 Delano
4,105,069 A 8/1978 Baker
4,271,916 A 6/1981 Williams
4,300,633 A 11/1981 Stewart
RE31,190 E 3/1983 Detroit et al.
4,469,174 A 9/1984 Freeman
4,519,452 A 5/1985 Tsao et al.
4,524,998 A 6/1985 Brisco
4,531,583 A 7/1985 Revett
4,548,271 A 10/1985 Keller
4,555,269 A 11/1985 Rao et al.
4,671,356 A 6/1987 Barker et al.
4,676,832 A 6/1987 Childs et al.
4,791,988 A 12/1988 Trevillion
4,919,456 A * 4/1990 Wong ..... 285/39
4,961,465 A 10/1990 Brandell
5,024,273 A 6/1991 Coone et al.
5,117,910 A 6/1992 Brandell et al.
5,125,455 A 6/1992 Harris et al.
5,133,409 A 7/1992 Bour et al.
5,147,565 A 9/1992 Bour et al.
5,188,176 A 2/1993 Carpenter
5,213,161 A 5/1993 King et al.
5,273,112 A 12/1993 Schultz
5,297,634 A 3/1994 Loughlin
5,318,118 A 6/1994 Duell
5,323,858 A 6/1994 Jones et al.
5,361,842 A 11/1994 Hale et al.
5,484,019 A 1/1996 Griffith
5,494,107 A 2/1996 Bode ..... 166/285
5,507,345 A 4/1996 Wehunt, Jr. et al.
5,559,086 A 9/1996 Dewprashad et al.
5,571,281 A 11/1996 Allen
5,577,865 A 11/1996 Manrique et al.
5,641,021 A 6/1997 Murray et al.
5,647,434 A 7/1997 Sullaway et al.
5,671,809 A 9/1997 McKinzie
5,718,292 A 2/1998 Heathman et al.
5,738,171 A 4/1998 Szarka
5,749,418 A 5/1998 Mehta et al.
5,762,139 A 6/1998 Sullaway et al.
5,803,168 A 9/1998 Lormand et al.
5,829,526 A 11/1998 Rogers et al.
5,875,844 A 3/1999 Chatterji et al.
5,890,538 A 4/1999 Beirute et al.
5,897,699 A 4/1999 Chatterji et al.
5,900,053 A 5/1999 Brothers et al.
5,913,364 A 6/1999 Sweatman
5,967,235 A * 10/1999 Scott ..... 166/379
5,968,255 A 10/1999 Mehta et al.
5,972,103 A 10/1999 Mehta et al.
6,060,434 A 5/2000 Sweatman et al.
6,063,738 A 5/2000 Chatterji et al.
6,098,710 A 8/2000 Rhein-Knudsen et al.
6,138,759 A 10/2000 Chatterji et al.
6,143,069 A 11/2000 Brothers et al.
6,167,967 B1 1/2001 Sweatman
6,196,311 B1 3/2001 Treece et al.
6,204,214 B1 3/2001 Singh et al.
6,244,342 B1 6/2001 Sullaway et al. ..... 166/285
6,258,757 B1 7/2001 Sweatman et al.
6,311,775 B1 11/2001 Allamon et al.
6,318,472 B1 11/2001 Rogers et al.
6,367,550 B1 4/2002 Chatterji et al.
6,431,282 B1 8/2002 Bosma et al.
6,454,001 B1 9/2002 Thompson et al.
6,457,524 B1 10/2002 Roddy
6,467,546 B2 10/2002 Allamon et al.
6,481,494 B1 11/2002 Dusterhoft et al.
6,484,804 B2 11/2002 Allamon et al.
6,488,088 B1 12/2002 Kohli et al.
6,488,089 B1 12/2002 Bour et al.
6,488,763 B2 12/2002 Brothers et al.
6,540,022 B2 4/2003 Dusterhoft et al.
6,622,798 B1 9/2003 Rogers et al.
6,666,266 B2 12/2003 Starr et al.
6,732,797 B1 5/2004 Watters et al.
6,758,281 B2 7/2004 Sullaway et al.
6,802,374 B2 10/2004 Edgar et al.
6,808,024 B2 10/2004 Schwendemann et al.
6,810,958 B2 11/2004 Szarka et al.
7,225,871 B2 * 6/2007 Rogers et al. ..... 166/285
2003/0000704 A1 1/2003 Reynolds
2003/0029611 A1 2/2003 Owens
2003/0072208 A1 4/2003 Rondeau et al.
2003/0192695 A1 10/2003 Dillenbeck et al.
2004/0079553 A1 4/2004 Livingstone
2004/0084182 A1 5/2004 Edgar et al.
2004/0099413 A1 5/2004 Arceneaux
2004/0104050 A1 6/2004 Järvelä et al.
2004/0104052 A1 6/2004 Livingstone
2004/0112586 A1 * 6/2004 Matthews et al. ..... 166/68.5
2004/0177962 A1 9/2004 Bour
2004/0231846 A1 11/2004 Griffith et al. ..... 166/291
2005/0006103 A1 * 1/2005 McGuire et al. ..... 166/379
2005/0061546 A1 3/2005 Hannegan
2005/0082066 A1 * 4/2005 McGuire et al. ..... 166/379
2006/0016599 A1 1/2006 Badalamenti et al.
2006/0016600 A1 1/2006 Badalamenti et al.
2006/0042798 A1 3/2006 Badalamenti et al.
2006/0086499 A1 4/2006 Badalamenti et al.
2006/0086502 A1 4/2006 Reddy et al.
2006/0086503 A1 4/2006 Reddy et al.
2006/0131018 A1 6/2006 Rogers et al.

FOREIGN PATENT DOCUMENTS

GB 2193741 2/1988
GB 2327442 A 11/1999
GB 2348828 A 10/2000
RU 1542143 C 12/1994
RU 2067158 9/1996
RU 2 086 752 C1 8/1997
WO WO 2004/104366 12/2004
WO WO 2005/083229 A1 9/2005
WO WO 2006/008490 A1 1/2006
WO WO 2006/064184 A1 6/2006

OTHER PUBLICATIONS

Filippov, et al., "Expandable Tubular Solutions," Society of Petroleum Engineers, SPE 56500, Oct. 3-6, 1999.
Daigle, et al., "Expandable Tubulars: Field Examples of Application in Well Construction and Remediation," Society of Petroleum Engineers, SPE 62958, Oct. 1-4, 2000.
Carpenter, et al., "Remediating Sustained Casing Pressure by Forming a Downhole Annular Seal With Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.

Gonzales, et al., "Increasing Effective Fracture Gradients by Managing Wellbore Temperatures," IADC/SPE 87217, Mar. 2-4, 2004.
Fryer, "Evaluation of the Effects of Multiples in Seismic Data From the Gulf Using Vertical Seismic Profiles," SPE 25540, 1993.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al., "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing".
Abstract No. XP-002283586, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication From a Related Counter Part Application, Oct. 12, 2005.
Foreign Communication From a Related Counter Part Application, Sep. 30, 2005.
Foreign Communication From a Related Counter Part Application, Dec. 7, 2005.
Halliburton Brochure Entitled "Bentonite (Halliburton Gel) Viscosifier", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing FlexPlug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the Stratalock Stabilization System", 1998.
Halliburton Brochure Entitled "Perlite Cement Additive", 1999.
Halliburton Brochure Entitled "The Permseal System Versatile, Cost-Effective Sealants for Conformance Applications", 2002.
Halliburton Brochure Entitled "Pozmix® A Cement Additive", 1999.
Foreign Communication From a Related Counter Part Application, Dec. 9, 2005.
Foreign Communication From a Related Counter Part Application, Feb. 24, 2005.
R. Marquaire et al., "Primary Cementing by Reverse Circulation Solves Critical Problem in the North Hassi-Messaoud Field, Algeria", SPE 1111, Feb. 1966.
Foreign Communication From a Related Counter Part Application, Dec. 27, 2005.
Foreign Communication From a Related Counter Part Application, Feb. 23, 2006.
Foreign Communication From a Related Counter Part Application, Jan. 8, 2007.
Foreign Communication From a Related Counter Part Application, Jan. 17, 2007.
Foreign communication from a related counterpart application, Feb. 27, 2007.

* cited by examiner

METHOD AND MEANS TO SEAL THE CASING-BY-CASING ANNULUS AT THE SURFACE FOR REVERSE CIRCULATION CEMENT JOBS

BACKGROUND

The present invention relates generally to well head equipment for production wells. In particular, this invention relates to tools and methods for sealing the casing-by-casing annulus at the top of the well bore so that a positive pressure may be applied to the annulus.

Production wells typically have a surface casing that extends from the top of the well and into the earth to a relatively shallow depth. It is also typical for a production casing to be positioned concentrically within the surface casing and so as to extend from the top of the well to a relatively deep depth. A casing-by-casing annulus is defined between the surface casing and the production casing.

In certain instances, it is desirable to apply a pressure differential in the annulus relative to atmospheric pressure at the well head. For example, if a reverse circulation cement (RCC) job is to be performed in the annulus, the cement is pumped into the annulus under positive pressure to pump the cement composition down the annulus. Prior to applying the pressure differential in the annulus, steps must be taken to isolate or seal the annulus at the well head. Previously, blow out preventor (BOP) and/or well head equipment has been used to seal the annulus. However, typical blow out preventor and well head equipment do not provide access to the annulus for performing a reverse circulation cement job. Typical blow out preventor and well head equipment limits the use of reverse circulation cementing operations on wells where surface casing is not fitted to accept the wellhead equipment. Further, even where the surface casing is configured to accept the BOP and/or well head equipment, significant hot work is typically required to install BOP flanges or wellhead equipment to the surface casing.

SUMMARY

The present invention is directed to tools and methods for sealing the casing-by-casing annulus at the top of the well bore so that a positive pressure may be applied to the annulus.

More specifically, one embodiment of the present invention is directed to a seal of an annulus defined between an outer casing and an inner casing, the seal having: an anchor fastened to the outer casing; a head fastened to the anchor, wherein the head comprises an opening for fluid communication with the annulus; and a plug contacting the exterior of the inner casing and the head.

According to another embodiment of the invention, there is provided a method for sealing an annulus defined between an outer casing and an inner casing, the method having the following steps: fastening an anchor to the outer casing; fastening a head to the anchor; providing an opening for fluid communication with the annulus through the head; and plugging the annulus between the inner casing and the head.

Still another aspect of the invention provides a method for sealing an annulus defined between an outer casing and an inner casing, the method having steps as follows: fastening a lock ring to an anchor base, wherein the lock ring comprises a threaded fastener of the lock ring to the head; positioning the lock ring and anchor base about the outer casing; fastening a limit clamp to an exterior surface of the outer casing; repositioning the lock ring and anchor base so that the anchor base is in contact with the limit clamp; fastening a head to the lock ring; providing an opening for fluid communication with the annulus through the head; positioning a plug about the inner casing and in contact with the inner casing and the head; positioning a seal fitting clamp about the inner casing and in contact with the plug; positioning a bull cap about the inner casing and in contact with the seal fitting clamp; and fastening the bull cap to the head.

The features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings.

DETAILED DESCRIPTION

The details of the present invention will now be described with reference to the accompanying drawings. This specification discloses various types of tools and methods to install the tools to pack-off or seal the casing-by-casing annulus such that a positive pressure can be applied to the casing annulus. This is in conjunction with, but not limited to, performing a reverse circulation cement (RCC) job. These tools require little, if any, hot work to install. As used herein, the term "casing" refers to any casing, tubing, pipe, rods, or any other similar devices used in wellbores and known to persons of skill in the art.

Figure 1:
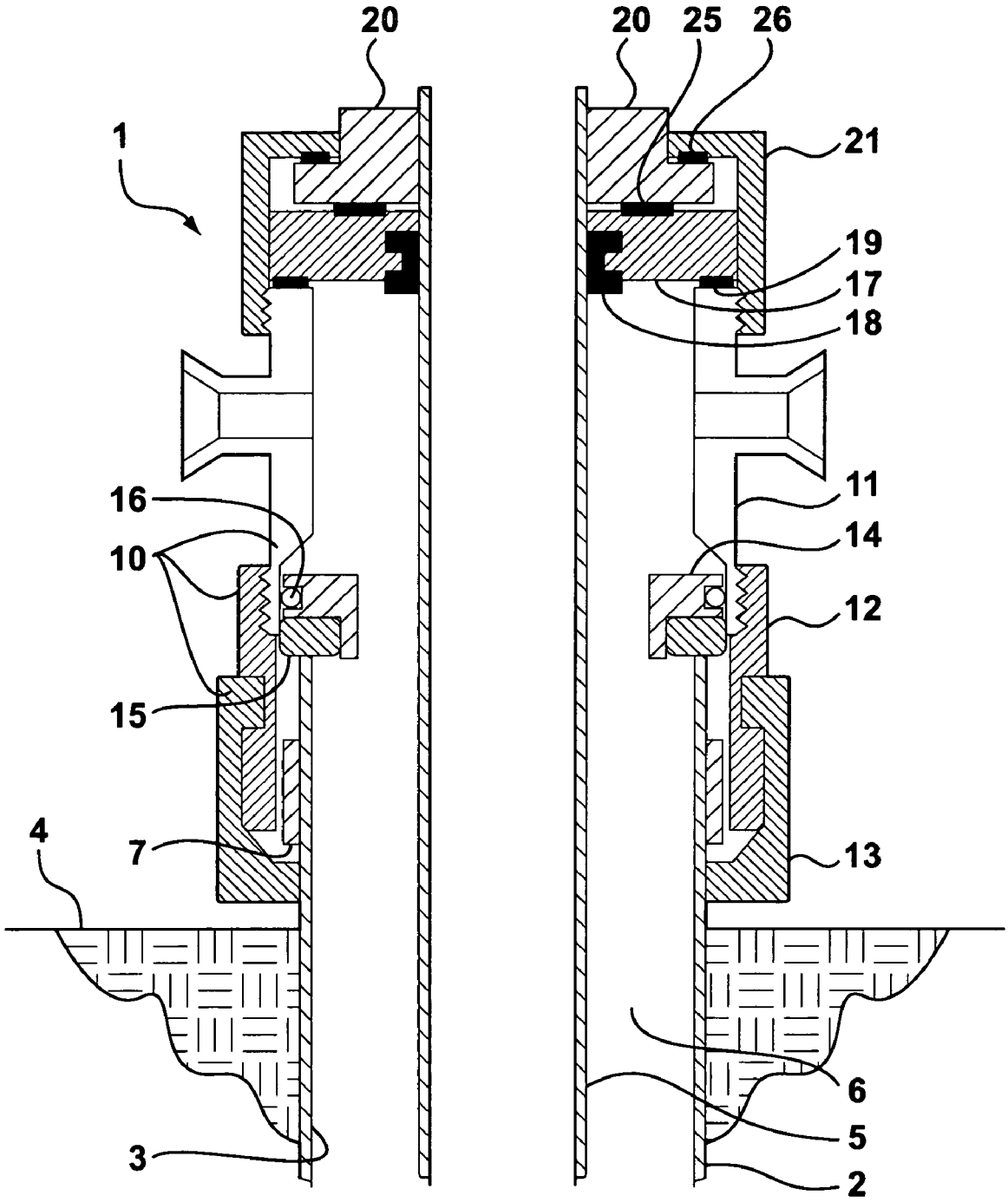
FIG. 1 is a cross-sectional side view of a casing-by-casing seal in a fully assembled configuration for sealing an annulus between a production casing and a surface casing.

Referring to FIG. 1, a cross-sectional, side view of an embodiment of a casing-by-casing annulus seal 1 is illustrated. A surface casing 2 extends from a well bore 3 above the surface of the ground 4. A production casing 5 is positioned concentrically within the surface casing 2 to define a casing-by-casing annulus 6. The production casing 5 extends further out of the well bore 3 than does the surface casing 2.

The casing-by-casing annulus seal 1 comprises several components. A limit clamp 7 is attached to the exterior of the surface casing 2 above the surface 4 of the ground. A quick latch 10 surrounds the limit clamp 7 and engages the surface casing 2 below the limit clamp 7 to provide a nippled head for fluid communication with the annulus 6. A bull cap 21 and seal fitting clamp 20 secure the production casing 5 to the head to close off the top of the annulus 6 above the head. These components and others are described more fully.

The limit clamp 7 is attached to the exterior of the surface casing 2 near its distal end protruding from the wellbore 3, as FIG. 1 illustrates. The quick latch 10 is also attached to the surface casing 2 and comprises three major components: a quick latch anchor base 13, a quick latch lock ring 12, and a quick latch head 11. The quick latch anchor base 13 has a lower interior flange that defines a hole through the center of the anchor only slightly larger than the outside diameter of the surface casing 2. The quick latch lock ring 12 is received into the opposite end of the quick latch anchor base 13 from the lower flange. A relatively smaller flange at the upper end of the quick latch anchor base 13 mates with a corresponding recess in the quick latch lock ring 12 to connect the components. The quick latch lock ring 12 has a female threaded end for receiving male threads on the quick latch head 11. The quick latch head 11 mates with the quick latch lock ring 12 via these threads. A seal gasket 14 seals the quick latch head 11 to the distal end of the surface casing 2. The seal gasket 14 has a casing/gasket seal 15 that extends between the surface casing 2 and the seal gasket 14. The seal gasket 14 also has a channel in its outer surface in which a head/gasket seal 16 is received. The head/gasket seal 16 seals the gap between the seal gasket 14 and the quick latch head 11.

A hinge plug 17 is positioned at the top of the quick latch head 11 and extends from the quick latch head 11 to the production casing 5. The hinge plug 17 has a casing/hinge plug 18 that extends between the hinge plug 17 and the production casing 5. The hinge plug 17 also has a head/hinge plug 19 that extends between the hinge plug 17 and the quick latch head 11. A seal fitting clamp 20 is positioned above the hinge plug 17 around the production casing 5. A clamp/hinge seal 25 is positioned between the hinge plug 17 and the seal fitting clamp 20. A bull cap 21 completes the assembly and is positioned above the seal fitting clamp 20 to sandwich the seal fitting clamp 20 and hinge plug 17 between the bull cap 21 and the quick latch head 11. A clamp/cap seal 26 is positioned between the seal fitting clamp 20 and the bull cap 21. Female threads at the lower end of the bull cap 21 mate with male threads on the quick latch head 11.

As shown in FIG. 1, the casing-by-casing seal 1 uses a modified quick latch coupling and a modified limit clamp attached to the surface casing or riser 2. The casing-by-casing seal 1 also uses a properly selected cement head to fit the surface casing 2 for a conventional cement job. The Quick Latch coupling may need to be modified to fit the inside and outside diameters of the surface casing, rather than the diameters of the casing collars. The casing-by-casing seal 1 uses a modified cement head cap or bull cap 21 that has a bore in the top with a rubber seal (clamp/cap seal 26) under the cap. The bore in the cap should slightly exceed the largest possible production casing 5 that could be set in the surface casing 2. In some embodiments of the invention, the quick latch 10 components, the seal gasket 14, and the bull cap 21 may be one-size-fits-all for a range of casing sizes, while the limit clamp 7, the hinge plug 17, and the seal fitting clamp 20 are precisely sized for individual casing sizes.

Figure 2A:
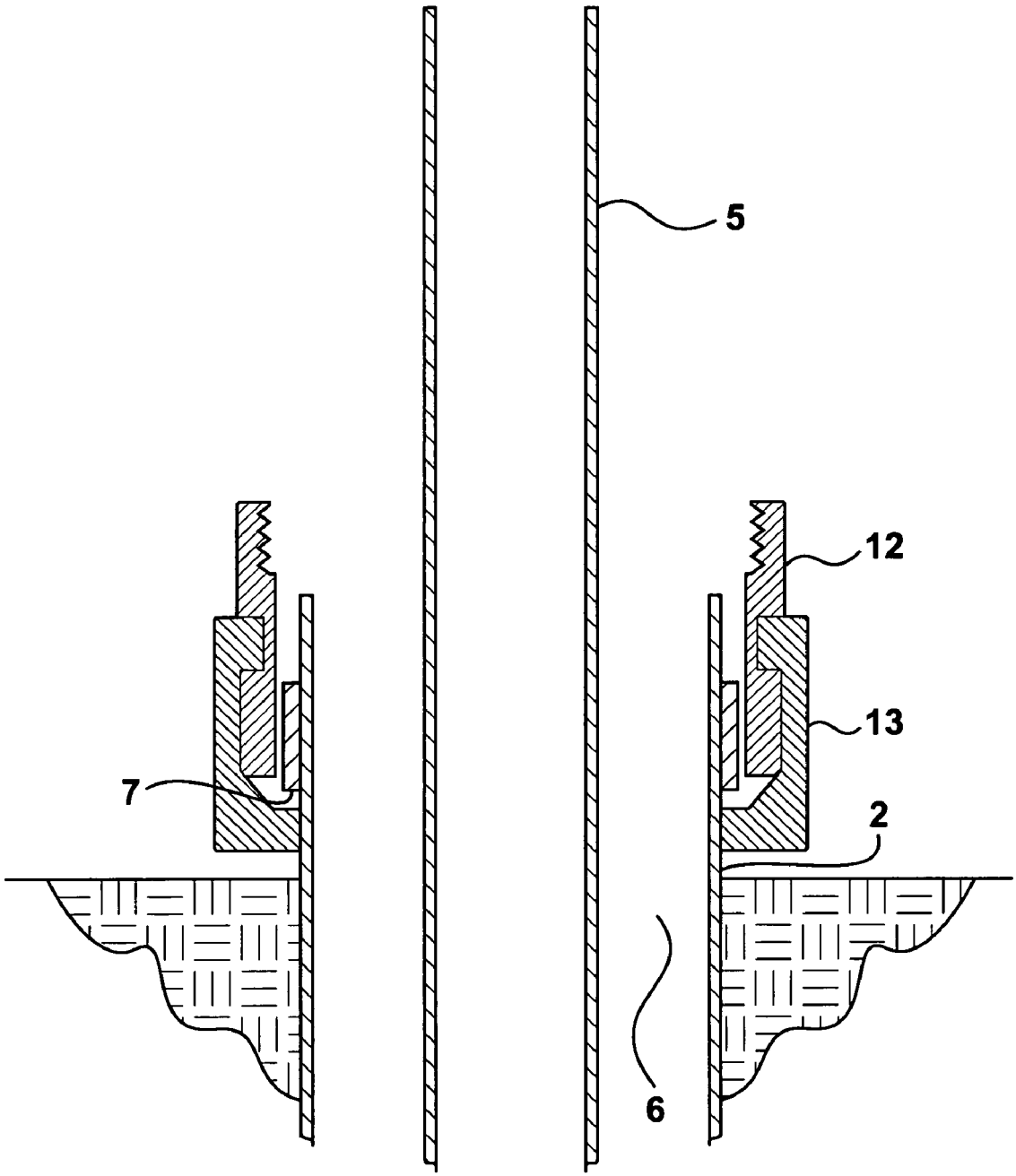
FIG. 2A is a cross-sectional, side view of a quick latch head, a quick latch lock ring and a limit clamp assembled to a surface casing.

The casing-by-casing seal 1, illustrated in FIG. 1, may be assembled in step wise fashion. Referring to FIG. 2A, the quick latch lock ring 12 and quick latch anchor base 13 are made up to each other so that a flange of the anchor base 13 mates with a recess of the lock ring 12. The quick latch lock ring 12 and quick latch lock anchor base 13 are then positioned over the distal end of the surface casing 2, with the threaded end of the lock ring 12 at the top. Because the inner diameter of the hole through the lower flange of the quick latch anchor base 13 is slightly larger of the outside diameter of the surface casing 2, the quick latch anchor base 13 easily slides over the end of the surface casing 2. The quick latch lock ring 12 and quick latch anchor base 13 are lowered to a position well below the distal end of the surface casing 2. A crane or air hoist may be used to lower the quick latch lock ring 12 and quick latch lock anchor base 13 over the production casing 5 and surface casing 2. The limit clamp 7 is then attached to the exterior of the surface casing 2 by any means known to persons of skill. For example, the limit clamp 7 may comprise two semicircular segments that are fastened together, an annular ring that is welded to the surface casing, and annular ring that is bolted or otherwise fastened to the casing, etc. In some embodiments of the invention, the limit clamp 7 may be a casing collar or a welded collar previously made part of the surface casing 2. In these cases, the quick latch anchor base 13 may be split in pieces for later assembly around the surface casing 2 below the limit clamp 7. With the limit clamp 7 fixed to the surface casing 2, the quick latch lock ring 12 and quick latch anchor base 13 are pulled upwardly until the flange of the quick latch anchor base 13 rests snugly against the lower edge of the limit clamp 7. Thus, the limit clamp 7 creates a shoulder that prevents further upward movement of the quick latch anchor base 13 relative to the surface casing 2.

Figure 2B:
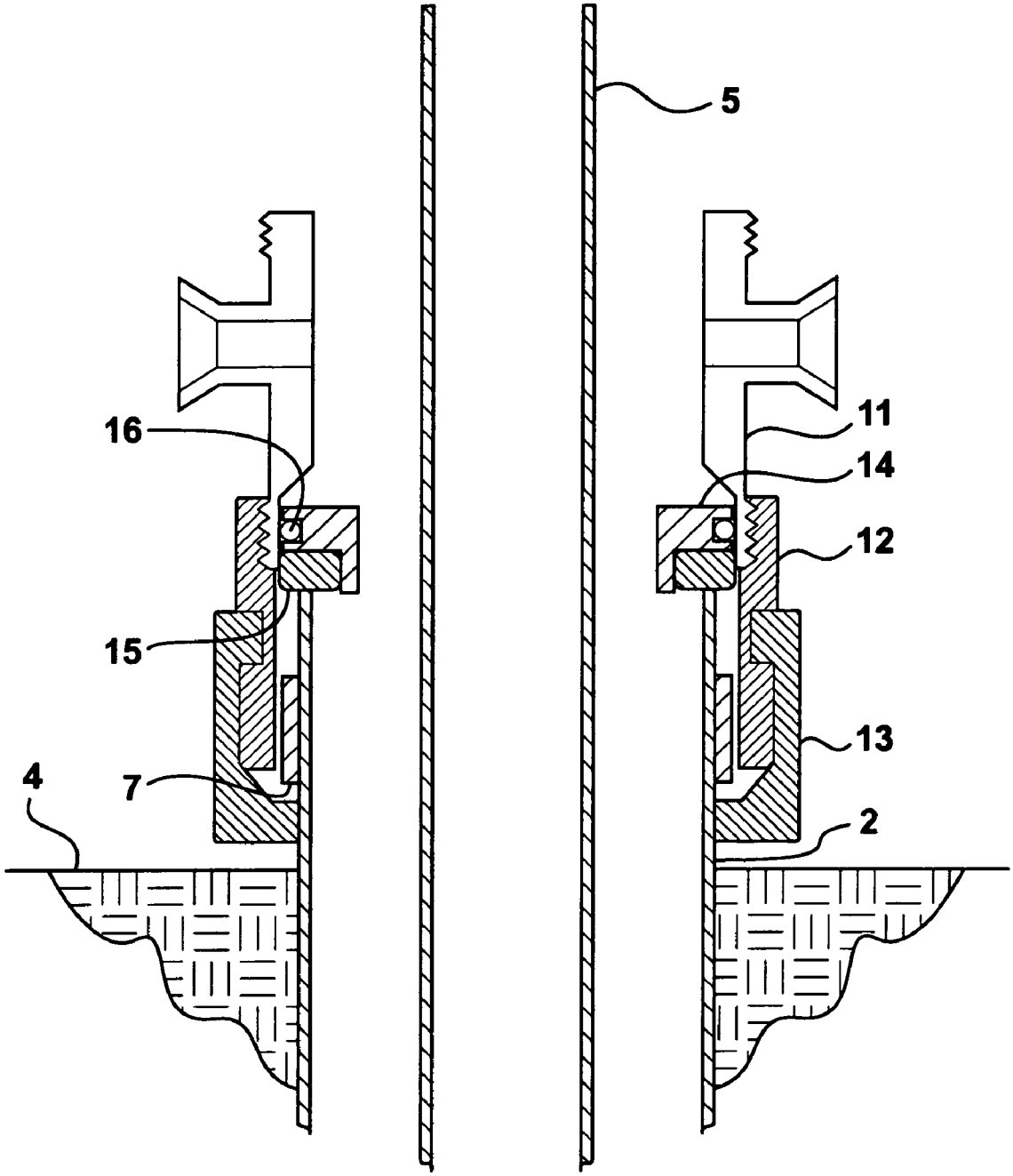
FIG. 2B is a cross-sectional, side view of the wellbore and casings shown in FIG. 2A, wherein a seal gasket and quick latch head are assembled to the surface casing.

As shown in FIG. 2B, the seal gasket 14 is then placed over the end of the production casing 5 and allowed to rest on the top of the surface casing 2. In particular, the seal gasket 14 has a casing/gasket seal 15 that rests on the extreme distal end of the surface casing 2. A crane or air hoist may be used to raise the quick latch lock ring 12 and quick latch anchor base 13 until they engage the lower shoulder of the limit clamp 7. Note that the limit clamp 7 was attached to the surface casing 2 at a precise location so as to allow the seal gasket 14 to be positioned concentrically inside the threaded portion of the quick latch lock ring 12. A crane or air hoist may be used to lower the quick latch head 11 over the production casing 5 and around the seal gasket 14. With the seal gasket 14 and quick latch lock ring 12 appropriately positioned, the quick latch head 11 is threaded into the quick latch lock ring 12. As these members are threaded together, an interior shoulder of the quick latch head 11 rests firmly on the top of the seal gasket 14 to drive the seal gasket 14 downwardly onto the extreme distal end of the surface casing 2. The quick latch head 11 also engages a head/gasket seal 16 around the periphery of the seal gasket 14. Because the quick latch anchor base 13 is held firmly in place by the limit clamp 7, the threading procedure firmly attaches the quick latch head 11 to the top of the surface casing 2. The casing/gasket seal 15 and the head/gasket seal 16 completely seal the connection between the quick latch head 11 and the surface casing 2.

Figure 2C:
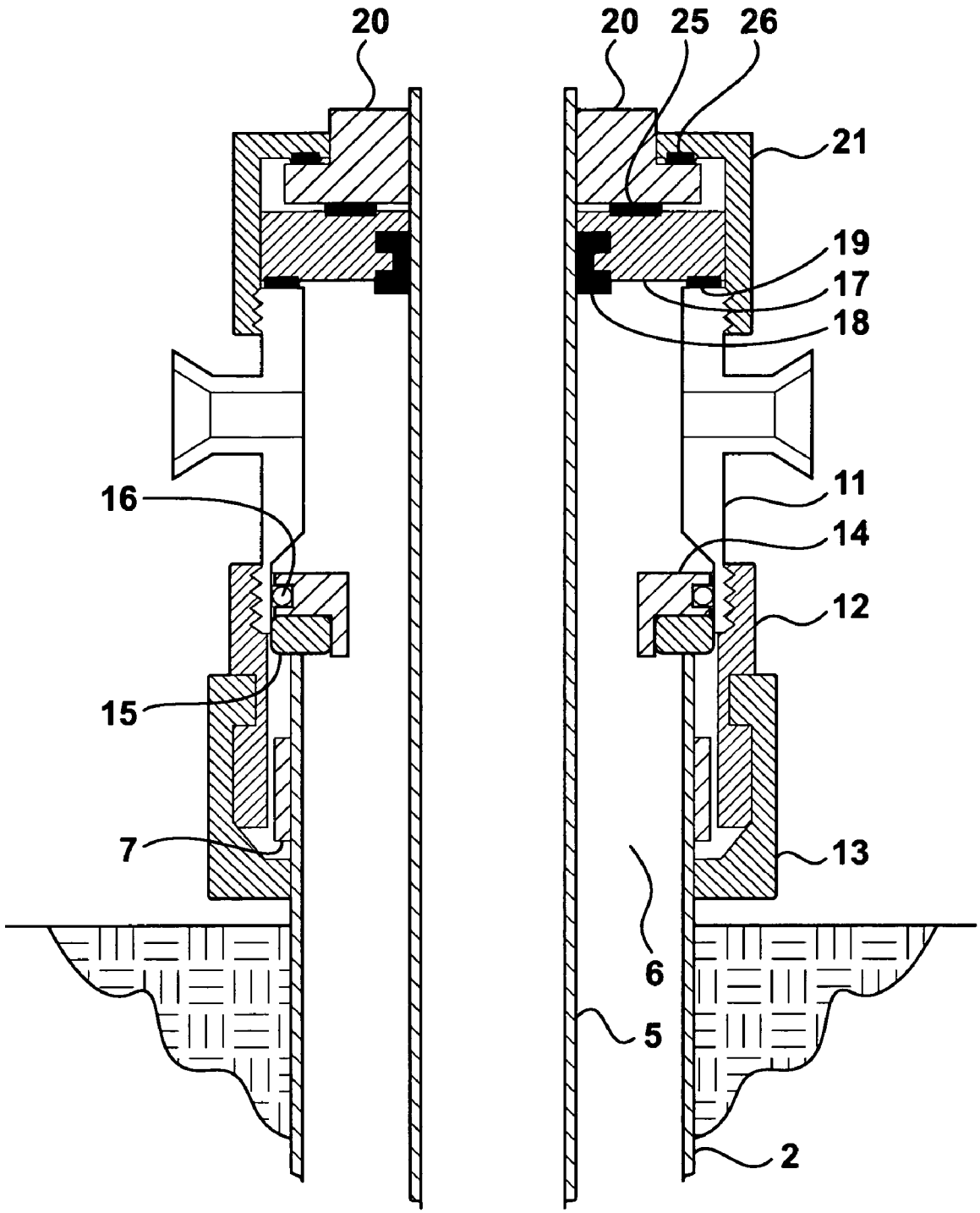
FIG. 2C is a cross-sectional, side view of the wellbore and casings shown in FIGS. 2A and 2B, wherein a head/hinge plug, a seal fitting clamp, and a bull cap are assembled to the production casing and quick latch head.

Referring to FIG. 2C, the annulus 6 is closed by assembling the hinge plug 17 to the top of the quick latch head 11. This may be done by placing the hinge plug 17 over the distal end of the production casing 5. The hinge plug 17 is lowered relative to the production casing 5 until it rests on the top of the quick latch head 11. This may be done with a crane or air hoist. Properly positioned, the head/hinge plug 19 rests on the top of the quick latch head 11. Also, the casing/hinge plug 18 of the hinge plug 17 firmly engages the production casing 5 because the parts are sized so as to squeeze the casing/hinge plug 18 between the production casing 5 and the hinge plug 17 when the parts are assembled. A crane or air hoist may then be used to place a seal fitting clamp 20 over the distal end of the production casing 5 and to lower it until it rest on the top of the hinge plug 17. A clamp/hinge seal 25 is positioned between the hinge plug 17 and the seal fitting clamp 20. Depending on the particular embodiment of the invention, a crane, air hoist, or drilling rig may then be used to lift up the production casing 5 so that the production casing 5 moves upward slightly relative to the stationary seal fitting clamp 20. The seal fitting clamp 20 is then fixed to the production casing 5. In some embodiments, the seal fitting clamp 20 comprises two, semi-circular parts that mate with each other to tighten a metal-to-metal seal with the production casing 5. The production casing 5 is then lowered so that the weight of the production casing 5 squeezes the hinge plug 17 between the seal fitting clamp 20 and the quick latch head 11. The production casing 5 may be lowered until the desired amount of weight is placed onto quick latch head 11 as measured with the weight indicator. A bull cap 21 is placed over the seal fitting clamp 20 and lowered relative to the assembly. A clamp/cap seal 26 is positioned between the bull cap 21 and the seal fitting clamp 20. In the embodiment shown, the seals are counter-sunk in the seal fitting clamp 20, but in alternative embodiments, any seal configuration known to persons of skill may be implemented. Female threads of the bull cap 21 are mated with male threads at the top of the quick latch head 11 so as to fasten the bull cap 21 to the quick latch head 11. As these members are threaded together, the hinge plug 17 and seal fitting clamp 20 are squeezed between the quick latch head 11 and the bull cap 21 to insure a complete seal of the annulus 6.

Figure 2D:
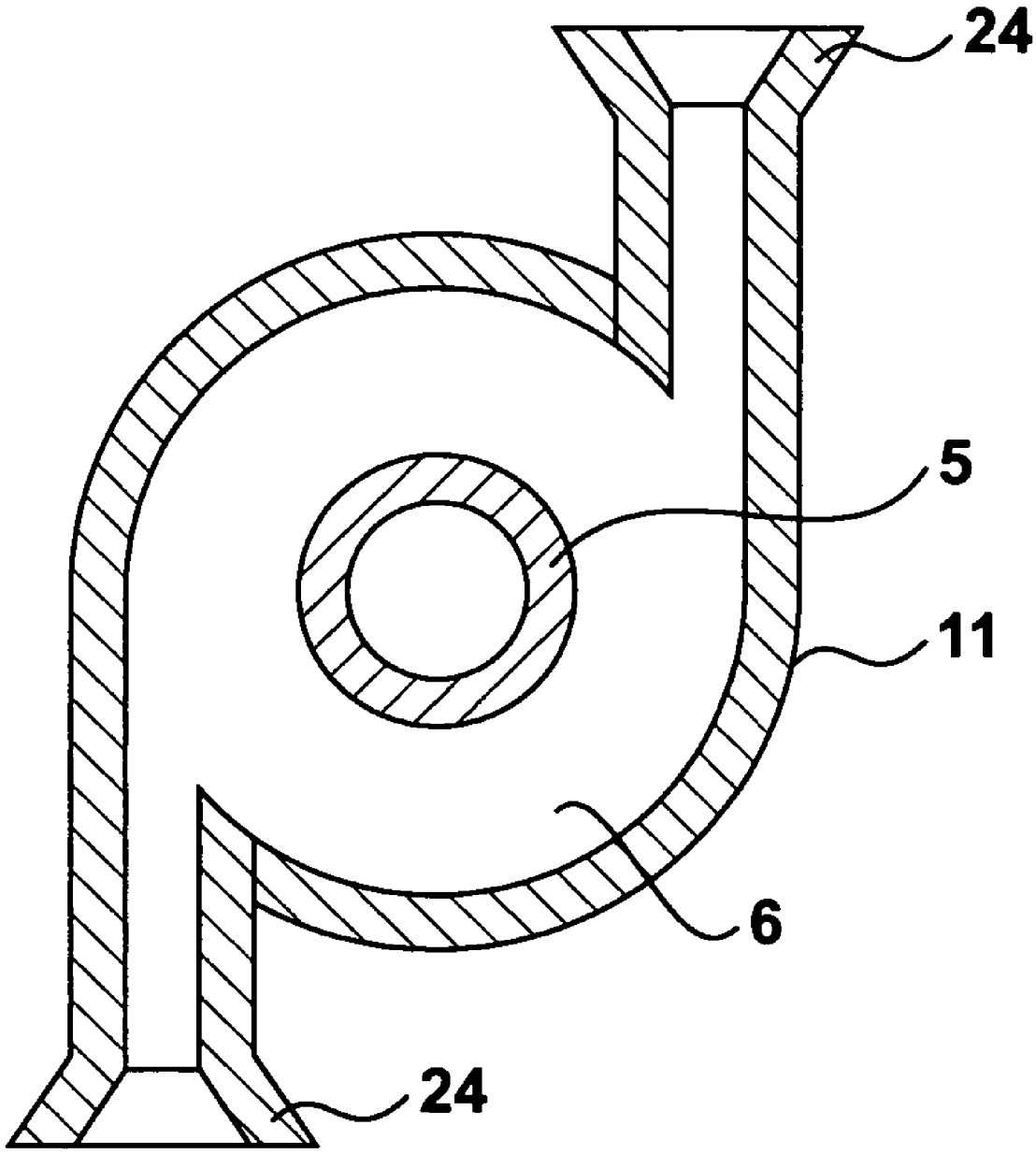
FIG. 2D is a cross-sectional, top view of the quick latch head and production casing wherein the quick latch head has two nipple connectors.

FIG. 2D is a cross-sectional, top view of the quick latch head 11. The quick latch head 11 has two nipple connectors 24 to which pipe and/or hose fittings are attached for fluid communication with the annulus 6. The annulus 6 is defined between the production casing 5 and the quick latch head 11.

Figure 3:
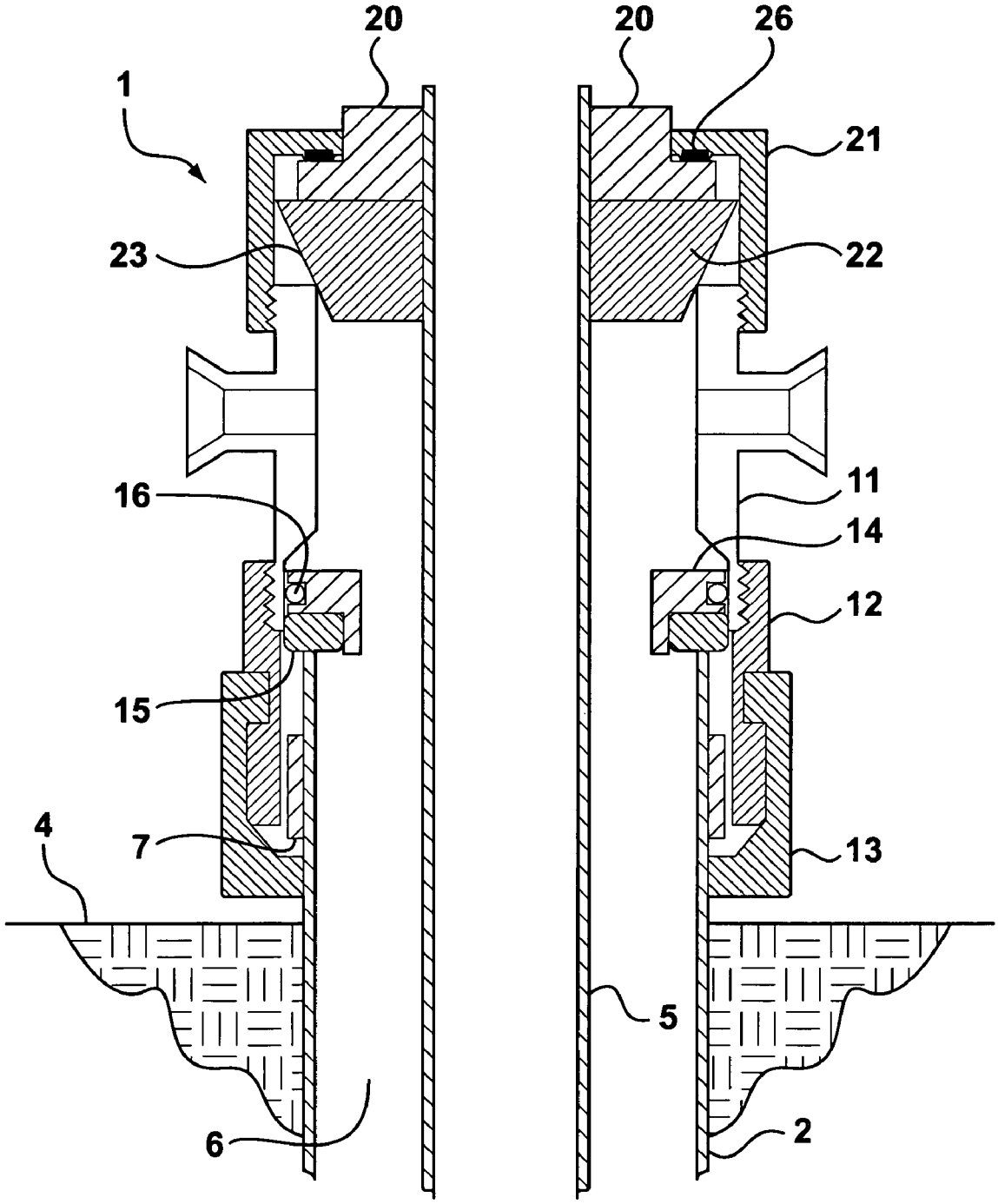
FIG. 3 is a cross-sectional, side view of a wellbore and casings with a fully assembled casing-by-casing seal.

Referring to FIG. 3, a cross-sectional side view of an alternative embodiment of a casing-by-casing seal 1 is illustrated. In this embodiment, a trapezoidal-shaped washer plug 22 is positioned around the production casing 5 above the quick latch head 11. In one embodiment, the washer plug 22 is an annular ring having a trapezoidal shape in cross-section. The inside diameter of the interior hole through the center of the annular washer plug 22 is slightly smaller than the outside diameter of the production casing 5 so that the seal 22 fits snugly around the production casing 5. Further, the washer plug 22 has a beveled surface 23 that engages the top of the quick latch head 11. In an alternative embodiment, the washer plug 22 is cut into segments so that the segments may be easily placed around the production casing 5 as opposed to the annular embodiment which is placed over the end of the production casing 5. Once assembled, the several seal segments mate and engage with each other to form a complete annular seal. FIG. 3 illustrates a seal fitting clamp 20 resting on top of the washer plug 22. A bull cap 21 engages a top surface of the seal fitting clamp 20. A clamp/cap seal 26 is positioned between the bull cap 21 and the seal fitting clamp 20. The bull cap 21 has a female thread for engaging the male threads on the top of the quick latch head 11.

As shown in FIG. 3, the casing-by-casing seal 1 uses a modified Quick Latch coupling and a modified limit clamp attached to the surface casing or riser 2. The casing-by-casing seal 1 also uses a properly selected cement head to fit the surface casing 2 for a conventional cement job. The casing-by-casing seal 1 uses a modified cement head cap or bull cap 21 that has a bore in the top with a rubber seal (washer plug 22) under the cap. The bore in the cap should slightly exceed the largest possible production casing 5 that could be set in the surface casing 2. The bore in the cap should slightly exceed the largest possible production casing 5 that could be set in the surface casing 2. In some embodiments of the invention, the quick latch 10 components, the seal gasket 14, and the bull cap 21 may be one-size-fits-all for a range of casing sizes, while the limit clamp 7, the washer plug 22, and the seal fitting clamp 20 are precisely sized for individual casing sizes.

In various embodiments of the casing-by-casing seal, different sealing mechanism may be used to achieve the casing-by-casing seal. In some embodiments, the seal uses the assistance of the seal fitting clamp 20 to help give a pressure seal using some of the weight of the production casing 5. In other embodiments, the seal fitting clamp 20 is not fixed to the production casing 5, such that the seal uses the bull cap 21 to tighten the washer plug 22 (rubber gasket) between the seal fitting clamp 20 and the quick latch head 11. Those embodiments that do not fix the seal fitting clamp to the production casing may be better suited for lower pressure needs or smaller rigs.

Figure 4A:
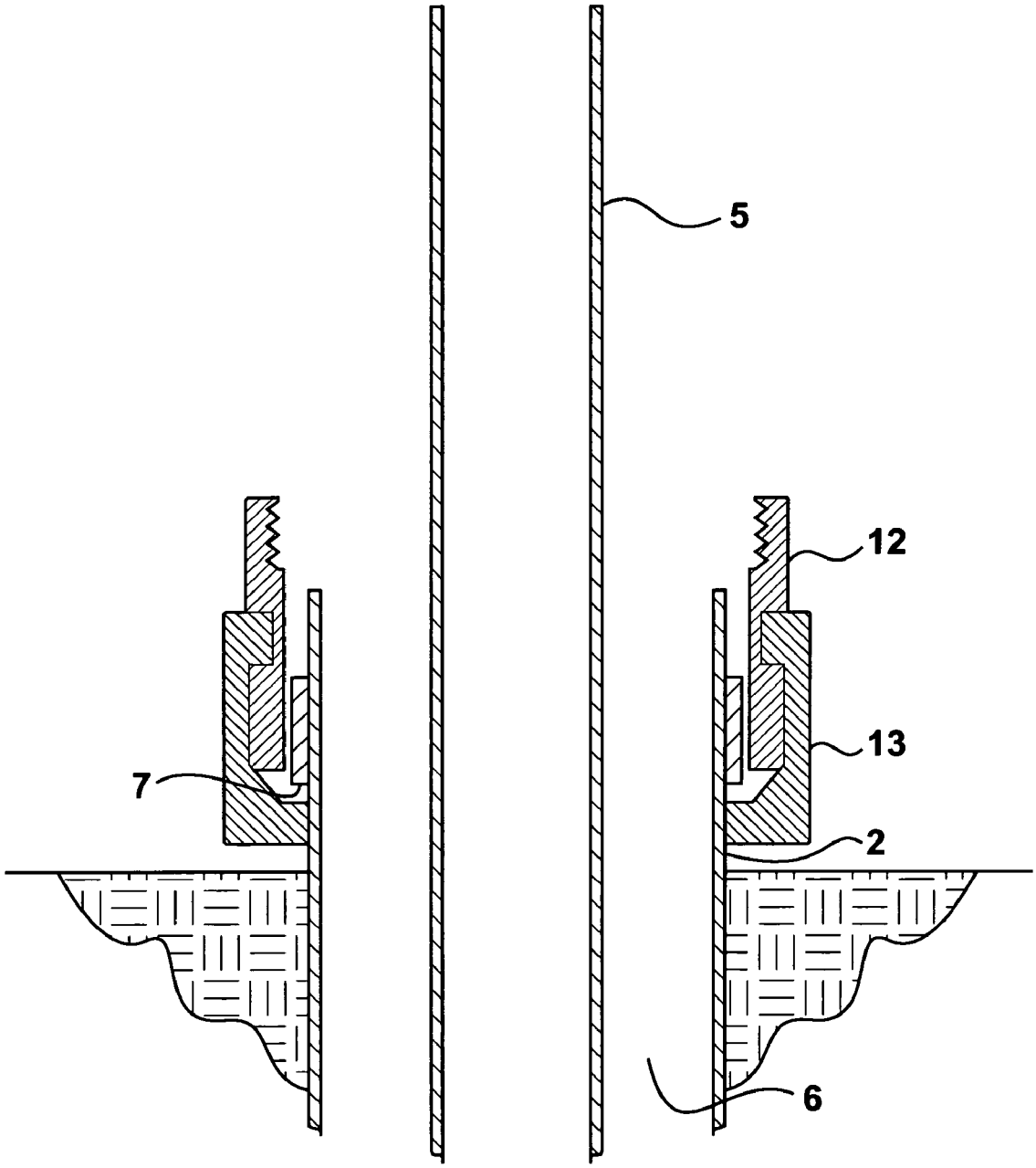
FIG. 4A is a cross-sectional, side view of a wellbore and casings with a quick latch lock ring, a quick latch anchor base, and a limit clamp assembled to the surface casing.

Referring to FIG. 4A, the quick latch lock ring 12 and quick latch anchor base 13 are made up to each other so that the flange of the anchor 13 mates with a recess of the lock ring 12. The quick latch lock ring 12 and quick latch anchor base 13 are then positioned over the distal end of the surface casing 2. Because the inner diameter of the hole through the lower flange of the quick latch anchor base 13 is slightly larger of the outside diameter of the surface casing 2, the quick latch anchor base 13 easily slides over the end of the surface casing. The limit clamp 7 is then attached to the exterior of the surface casing by any means known to persons of skill. For example, the limit clamp 7 may comprise two semicircular segments that are fastened together, an annular ring that is welded to the surface casing, and annular ring that is bolted or otherwise fastened to the casing, etc. With the limit clamp 7 in place, the quick latch lock ring 12 and quick latch anchor base 13 are pulled upwardly until the flange of the quick latch anchor base 13 rests snugly against the lower edge of the limit clamp 7. Thus, the limit clamp 7 creates a shoulder that prevents further upward movement of the quick latch anchor base 13 relative to the surface casing 2.

Figure 4B:
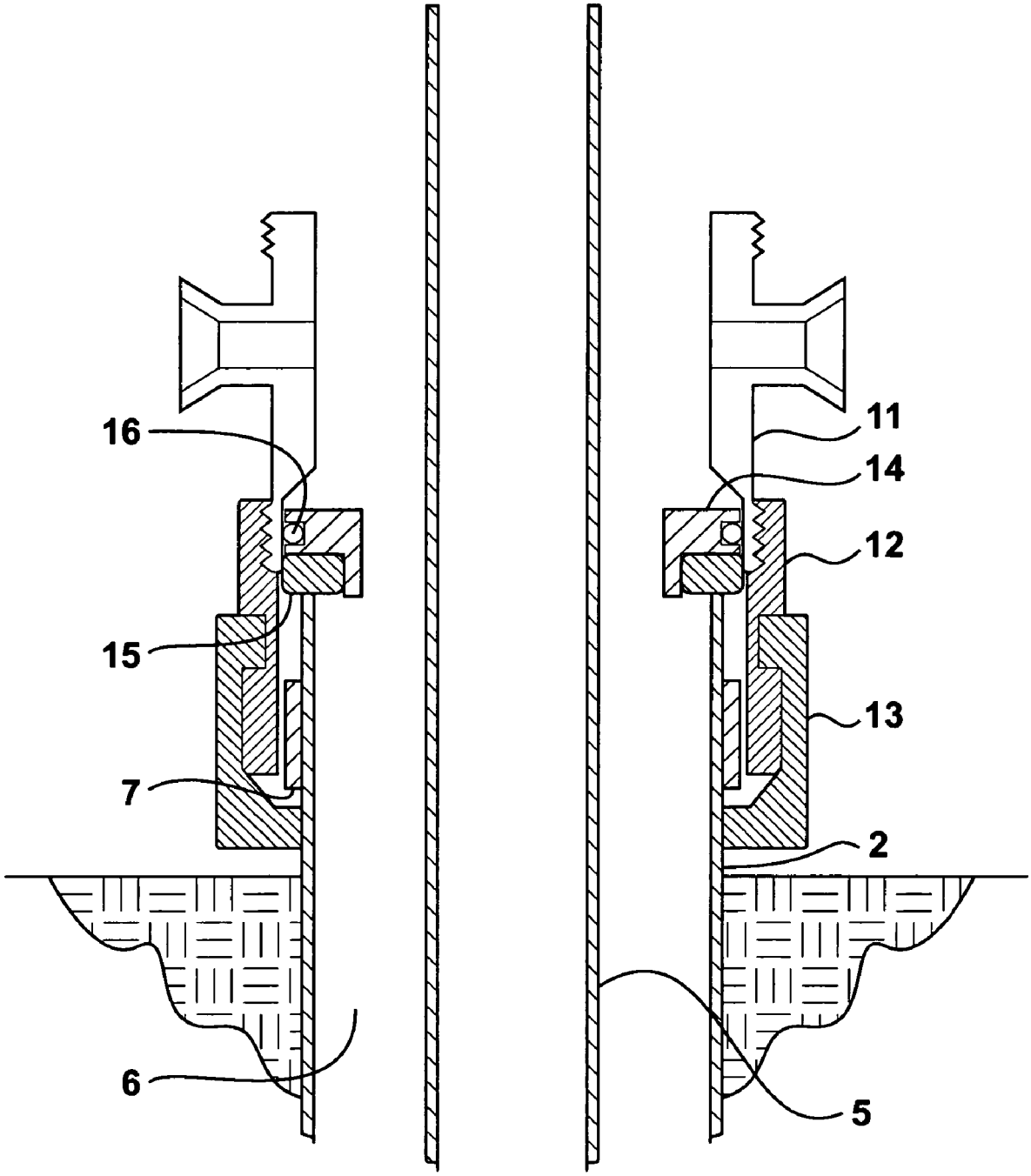
FIG. 4B is a cross-sectional, side view of the wellbore and casings shown in FIG. 4A, wherein a seal gasket and a quick latch head are assembled to the surface casing.

Referring to FIG. 4B, the seal gasket 14 is then placed over the end of the production casing 5 and allowed to rest on the top of the surface casing 2. In particular, the casing/gasket seal 15 rests on the extreme distal end of the surface casing 2. Note that the limit clamp 7 was attached to the surface casing 2 at a precise location so as to allow the seal gasket 14 to be positioned concentrically inside the threaded portion of the quick latch lock ring 12. With the seal gasket 14 and quick latch lock ring 12 so positioned, the quick latch head 11 is threaded into the quick latch lock ring 12. As these members are threaded together, an interior shoulder of the quick latch head 11 rests firmly on the top of the seal gasket 14 to drive the seal gasket 14 down onto the extreme distal end of the surface casing 2. Because the quick latch anchor base 13 is held firmly in place by the limit clamp 7, the threading procedure firmly attaches the quick latch head 11 to the top of the surface casing 2.

Figure 4C:
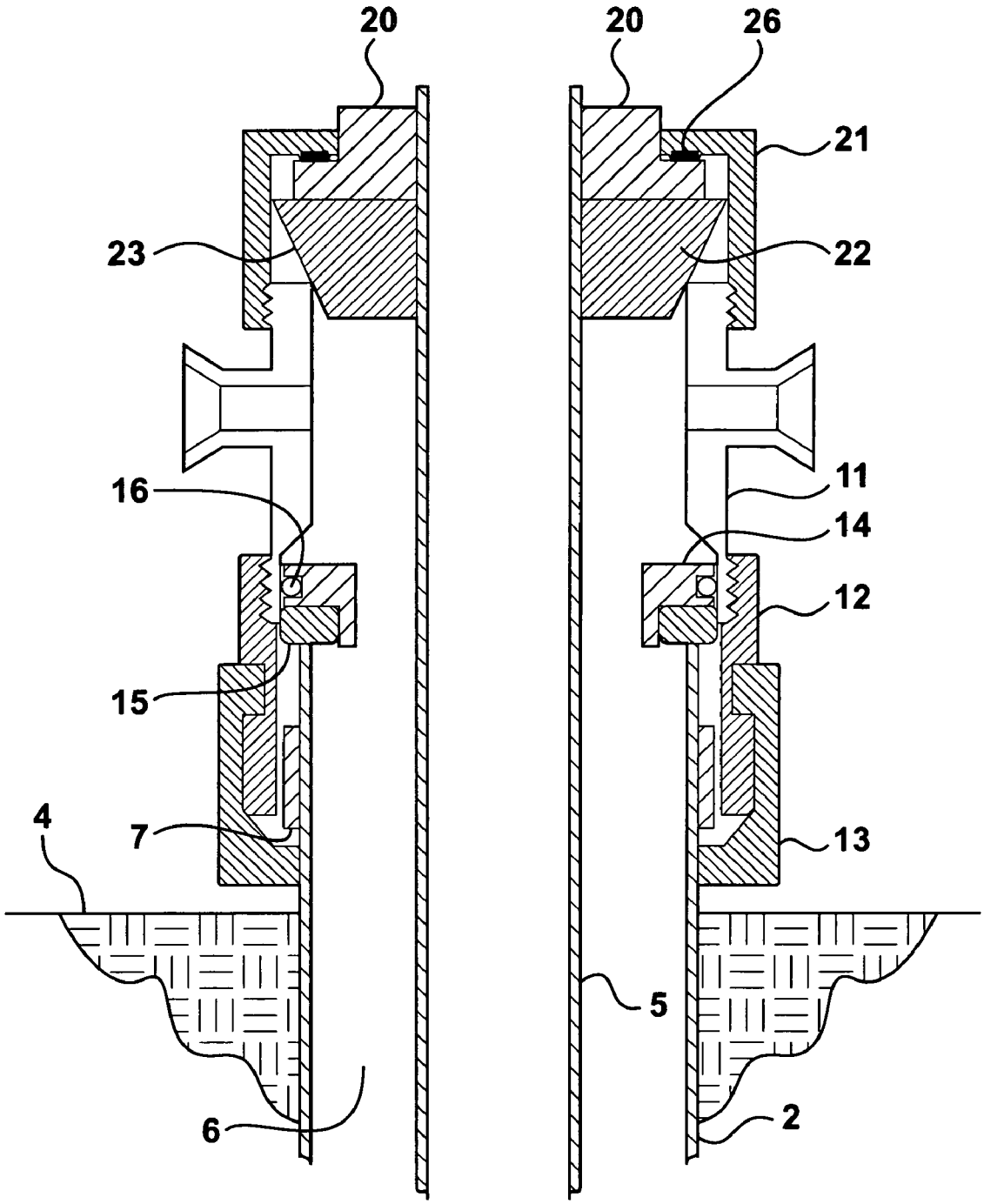
FIG. 4C is a cross-sectional, side view of the wellbore and casings shown in FIGS. 4A and 4B, wherein a washer plug, a seal fitting clamp, and a bull cap are assembled to the production casing and the quick latch head.

Referring to FIG. 4C, the washer plug 22 is positioned around the outside of the production casing 5 in a manner depending upon the particular embodiment of the washer plug 22. For washer plugs 22 that are annular in construction, the washer plug 22 is placed over the end of the production casing 5. The washer plug 22 is then translated down the length of the production casing 5 until it engages the top of the quick latch head 11. For embodiments of the washer plug 22 that are segmented, the individual segments are simply placed around the production casing 5 at the top of the quick latch head 11. With the washer plug 22 in place, a seal fitting clamp 20 is positioned over the top of the production casing 5 and translated down the production casing 5 until it rests on the top of the washer plug 22. In the illustrated embodiment, the seal fitting clamp 20 is not fixed to the production casing 5, rather the seal fitting clamp 20 is allowed to freely move relative to the production casing 5. The bull cap 21 is then positioned over the end of the production casing 5 and translated down the length of the production casing until it rests on top of the seal fitting clamp 20. The bull cap 21 engages a top surface of the seal fitting clamp 20 and surrounds at least a portion of the seal fitting clamp 20 and the washer plug 22. The bull cap 21 has female threads which engage the male threads at the top of the quick latch head 11. The relative sizes of the washer plug 22, the seal fitting clamp 20, and the bull cap 21 are such that when the bull cap 21 is threaded on to the quick latch head 11, the bull cap 21 and seal fitting clamp 20 bear down on the washer plug 22 so as to squeeze the washer plug 22 between the quick latch head 11 and the seal fitting clamp 20. Further, because the washer plug 22 has a beveled surface 23, when the bull cap 21 and the seal fitting clamp 20 bear down on the washer plug 22, the washer plug 22 is squeezed radially inward toward the production casing 5 to produce a complete seal of the annulus 6. The washer plug 22 forms a sealed contact with the production casing 5 and the quick latch head 11.

Once a casing-by-casing seal 1 is properly installed, a reverse circulation cement job may be commenced and executed in a safe and effective way. The cement composition may be injected under pressure into the annulus 6 through one of the nipple connectors 24. Clearly, if only one nipple connector 24 is used for the injection step, all other nipple connectors 24 must be capped off before pressure will build in the annulus. After the cement composition is set in the annulus 6, the casing-by-casing seal 1 may be removed from the wellhead and repaired as needed for other jobs.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of sealing a reverse circulation annulus defined between an outer casing and an inner casing, comprising:

fastening a split-ring anchor to the outer casing;

fastening a head to the anchor;

providing an opening for fluid communication with the annulus through the head; and plugging the annulus between the inner casing and the head, wherein plugging the annulus comprises:

contacting a plug with the inner casing and the head;

lifting the inner casing relative to the outer casing;

fastening a seal fitting clamp to the inner casing above the plug; and lowering the inner casing relative to the outer casing to squeeze the plug between the seal fitting clamp and the head.

2. The method of claim 1 wherein fastening the anchor comprises:

fastening a limit clamp to the outer casing;

fastening a lock ring to an anchor base, wherein the lock ring comprises a threaded fastener of the lock ring to the head; and contacting the anchor base and the limit clamp.

3. The method of claim 1 wherein fastening the anchor comprises fastening the anchor to an exterior of the outer casing.

4. The method of claim 1 wherein fastening the head to the anchor comprises mating threads on the head with threads on the anchor.

5. The method of claim 1 wherein providing the opening comprises providing two openings for fluid communication with the annulus, and providing each of the two openings with a nipple connector.

6. The method of claim 1 wherein:

the plug comprises a hinge plug; and plugging the annulus further comprises:

contacting the hinge plug with the inner casing and the head;

contacting the seal fitting clamp with the hinge plug;

contacting a bull cap with the seal fitting clamp; and fastening the bull cap to the head.

7. The method of claim 1 wherein:

the plug comprises a washer plug; and plugging the annulus further comprises:

contacting the washer plug with the inner casing and the head;

contacting the seal fitting clamp with the washer plug;

contacting a bull cap with the seal fitting clamp; and fastening the bull cap to the head.

8. The method of claim 1 further comprising positioning a seal gasket between the outer casing and the head.

9. A method of sealing a reverse circulation annulus defined between an outer casing and an inner casing, comprising:

fastening a lock ring to a split-ring anchor base, wherein the lock ring comprises a threaded fastener of the lock ring to the head;

positioning the lock ring and anchor base about the outer casing;

fastening a limit clamp to an exterior surface of the outer casing;

repositioning the lock ring and anchor base so that the anchor base is in contact with the limit clamp;

fastening a head to the lock ring;

providing an opening for fluid communication with the annulus through the head;

positioning a plug about the inner casing and in contact with the inner casing and the head;

positioning a seal fitting clamp about the inner casing and in contact with the plug;

positioning a bull cap about the inner casing and in contact with the seal fitting clamp;

fastening the bull cap to the head;

lifting the inner casing relative to the outer casing;

fastening the seal fitting clamp to the inner casing above the plug; and lowering the inner casing relative to the outer casing to squeeze the plug between the seal fitting clamp and the head.

* * * * *